United States Patent [19]

Dungl

[11] 4,329,981

[45] May 18, 1982

[54] FOOT MASSAGE MAT

[75] Inventor: Willi Dungl, Vienna, Austria

[73] Assignee: Semperit AG, Vienna, Austria

[21] Appl. No.: 115,620

[22] Filed: Jan. 28, 1980

[51] Int. Cl.[3] ..... A61H 1/02

[52] U.S. Cl. ..... 128/25 B

[58] Field of Search ..... 128/25 B; 4/185 R, 185 F

[56] References Cited

U.S. PATENT DOCUMENTS

| | | | |
|---|---|---|---|
| 2,476,921 | 7/1949 | Shock | 128/25 B |
| 2,820,454 | 1/1958 | Wright | 128/25 B |
| 3,100,483 | 8/1963 | Altmeyer et al. | 128/25 B |
| 3,744,483 | 7/1973 | Picolin | 128/25 B |
| 3,885,555 | 5/1975 | Nobbs | 128/25 B |

*Primary Examiner*—John D. Yasko

*Attorney, Agent, or Firm*—Werner W. Kleeman

[57] ABSTRACT

A foot massage mat formed of rubber, plastics material or the like wherein the mat possesses hill-like protuberances.

19 Claims, 8 Drawing Figures

FOOT MASSAGE MAT

BACKGROUND OF THE INVENTION

The present invention relates to a new and improved construction of a foot massage mat formed of rubber, plastics material or the like.

A great many pains in the feet and legs, but also in the spinal column and the like, are attributal to the fact that the foot within the shoe and when walking upon relatively unyieldable surfaces or floors, cannot be naturally loaded. Hence, there arise not only problems as concerns blood circulation but also myoatrophy, injuries to the joints, intervertebral injuries and many other illnesses. One of the important prerequisites for physical training, both for athletic and health reasons therefore resides in attaining an improvement, for instance by resorting to appropriate auxiliary means or aids, such as for instance massages.

SUMMARY OF THE INVENTION

Therefore, with the foregoing in mind it is a primary object of the present invention to provide a new and improved construction of a foot massage mat which when the user passes thereover, either by walking thereover, hopping thereon or otherwise coming into contact therewith, produces a natural massage effect, but however at the same time is structured such that even an unskilled individual will not become injured through improper use of the foot massage mat.

Yet a further significant object of the present invention aims at providing a new and improved construction of a foot massage mat affording good massaging of the feet of the user, and which mat is relatively simple in construction and design, economical to manufacture, extremely easy to use and is structured such that unskilled individuals using the mat are not prone to suffer injury even if the foot massage mat is improperly used.

Now in order to implement these and still further objects of the invention, which will become more readily apparent as the description proceeds, the foot massage mat of the present development is formed of a material selected from rubber, plastics or the like and has hill-like raised portions or protuberances. These hill-like raised portions, when the user walks thereover, produce a beneficial pressing or squeezing of the sole of the foot, an agitation of the different reflex zones and a direct and indirect loading of the muscles which participate in the movements of the user. The thus realized improvement of the blood circulation, in the case of healthy individuals, enhances their feeling of well-being, and in the case of patients undergoing rehabilitation accelerates the healing or normalization process.

A particularly advantageous massage effect can be realized if the size of the raised portions or protuberances and the intermediately disposed valleys are approximately the same size as a footprint of a healthy grown human. In this case the raised portions fit into the free space formed below the foot arch and thus support the same. At the same time the heel and the region of the toe ball comes to line in a valley, whereas the toes themselves bear upon a neighboring raised portion or protuberances. Since there is no standard for the footprint of a healthy grown human, rather such can be differently patterned according to the size of the feet, the invention contemplates either providing for different feet sizes foot massage mats having different size of the protuberances and valleys situated therebetween or providing at one mat the different constructional possibilities. As a rule, according to the invention it will suffice to have a height of the raised portions or protuberances between about 1 to 4 centimeters. The height of the raised portion should be somewhat greater than the height of the arch of the foot, so that there can be applied at the highest location of the foot arch an appropriate massage effect.

In order to render such type constructed foot massage mat independent of the direction that the user passes thereover, it is advantageous if the raised portions or protuberances possess an approximately circular-shaped configuration in plan view, and the diameter of the circular protuberances in plan view is in the order of between about 5 and 10 centimeters. In accordance with the above observations, such variations in the diameter of the circular raised portions or cross-section thereof are necessary in order to accommodate the foot massage mat to different feet sizes of the users.

In order to obtain a uniform massaging effect upon the foot during one or a number of steps taken over the mat by the user, it is advantageous if a number of raised portions or protuberances are distributively arranged in spaced relationship from one another. The distribution of the raised portions can be regular or irregular. A regular or equidistant distribution of the raised portions allows for a much better predetermination as to the detailed type of load to which the foot is subjected upon passage over the foot massage mat. On the other hand, with irregular distribution of the raised portions the loading or massage effect to which the user's foot is exposed is more random and, in this case, there is obtained an extensive simulation of a natural floor.

So that during rolling of the foot over the foot massage mat it is possible for as many of the regions of the foot sole to be engaged by the surface of the mat, it is advantageous if the spacing of the protuberances or raised portions from one another, measured from apex to apex, amounts to between about eight and about fifteen centimeters. Such dimensions enable, on the one hand, in accordance with the previously discussed size criteria, an accommodation to exactly defined conditions as concerns the foot size or also an intentional accentuation of the effect of the irregularity or randomness.

In the ideal case the spacing between the raised portions should be accommodated to the foot of the user such that the heel and toe ball come to lie in a valley, the foot arch and toes come to lie upon a raised portion. In fact, with appropriate dimensioning of the valleys and raised portions there is absolutely possible the realization of this concept, if there is employed as the material for the mat an appropriately flexible material which, in turn, can adapt to the contour of the footprint.

For the purpose of athletic physical training and fitness, as a general rule, it is more advantageous if there are provided at a mat surface raised portions of different size and/or different spacing from one another. This is also of advantage because it is then possible at such type constructed mat for different individuals to carry out their training exercises, and for each individual there is present at a predetermined region of the mat exactly suitable conditions, in other regions, however, the foot can give in accordance with the randomness of the mat surface configuration, and therefore, it is possible to correspondingly train the muscles participating in movement and the foot joint.

In order to obtain an intensive massaging effect, it is advantageous if at least the raised portions have a structured surface design. In this case, the portions of the feet which participate in the rolling action are additionally thoroughly massaged at each portion of the foot coming into contact with the mat. The surface design or pattern can consist of adjacently arranged naps, however a round pebble-like construction has been found to be particularly advantageous. Due to the round pebble-like structure there can be realized an optimum massage effect, since by means of the individual pebble elements it is possible to differently load or massage closely situated locations of the foot sole, without there arising abrupt load limits. There is thus realized a particularly protective massage effect.

It is advantageous if the gravel or pebble elements, forming the round pebble-like structure, have different sizes in the order of between about one centimeter to about three centimeters in length. What is particularly advantageous for the massaging effect is if the gravel or pebble elements protrude at least partially from the mat surface, for instance by about three to about seven millimeters, since then it is possible to obtain a still better blood circulation by virtue of the deformation and subsequent return of these protruding portions back into their original position.

For maintaining clean, and thus, establishing faultless hygienic conditions it is necessary that the surface design or pattern be constructed in such a manner that it allows for a complete running-off of liquid from the foot massage mat which is erected so as to be inclined at an angle of about 45°. After using the foot massage mat it can be simply washed with water or, if desired, any suitable cleaning and disinfection agent and by propping such up at an inclination against a wall the mat can be dried, without any liquid residues being entrapped in pockets of the mat, which otherwise would constitute breeding places for bacteria or spores. In this connection it is also necessary that the surface, including possible structured parts, be macroscopically smooth and closed. In order to provide a certain flexibility as to the size of the inventive foot massage mat, it is advantageous if the mat is assembled together from tile-like individual elements. Depending upon the wishes and conditions imposed by the user it is then possible to form a suitable size and configured surface by assembling together these individual elements.

In order to obtain an endless mat surface which is provided, without interruptions, uniformly with protuberances or raised portions, it is possible to form appropriate parts of the raised portions or protuberances at the edges and corners of the tile-like individual elements, which then can be augmented by analogously constructed neighboring individual elements. This means that at the edges there are formed half portions of the protuberances and at the corners quarter portions of the protuberances. When assembling together two individual elements two half protuberance portions are joined together such that there is formed a complete protuberance or raised portion. In order to allow for a certain degree of flexibility when assembling together the individual elements, and in order to be able to join together the individual elements in every position, it is advantageous if, in the case of a square individual element, the parts of the raised portions or protuberances which are formed at the corners and edges merge at all four sides in approximately the same contour. It is then immaterial which side of an individual element is joined with which side of another individual element, since in each case there is obtained a suitable transition between the protuberances or raised portions.

Of course, it is also possible that all of the edges of an individual element only are located at the valley region between raised portions, so that it is not only possible to assemble the mat so as to have equal corners but also a randomly offset assembly of the mat is possible.

In order to obtain a mutual positional fixation of the individual elements, it is advantageous if the tile-like individual elements are provided with interengaging or interfitting lateral projections and recesses for assisting in assembly of the individual elements. If these lateral projections and recesses are structured so as to be dovetail-shaped, then apart from securing the individual elements against any lateral shifting there is also prevented spreading apart of the joints between the individual elements.

The inventive foot massage mat possesses outstanding use properties if it is formed of a semi-rigid polyurethane integral foam. Polyurethane integrated foam belongs to the group of flexible polyurethane foams, that is to say, it can deform when subjected to load and when load relieved again restores back into its original shape. Polyurethane integral foams which come under consideration for use with the practice of the invention have a density (measured according to DIN 53550) between 100 and 800 kg/m$^3$, a breaking elongation (measured according to DIN 53504) between 10% and 300%, and a Shore A-hardness (measured according to DIN 53505) of at least 50°. The term "integral foam" signifies that the foam superficially possesses a more or less compact skin which is smooth towards the outside. Hence, this material can fulfil the hygienic requirements placed upon a foot massage mat.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
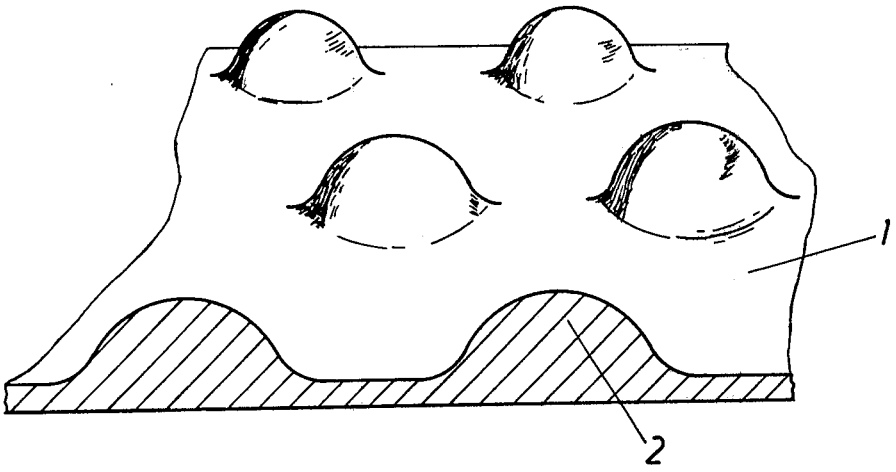
FIG. 1 is a fragmentary sectional view of a foot massage mat constructed according to the invention.
Figure 2:
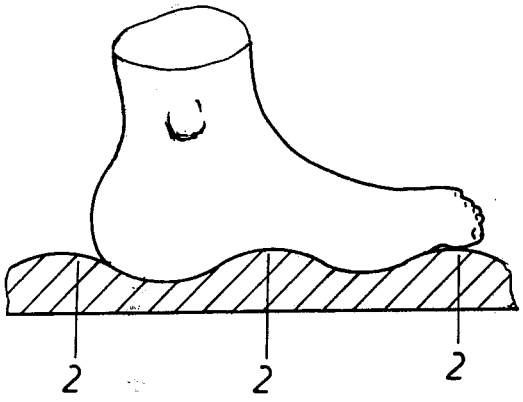
FIG. 2 is a cross-sectional view of the mat showing the user's foot placed thereon.

Describing now the drawings, FIG. 1 illustrates in fragmentary sectional view part of a foot massage mat 1 containing raised portions or protuberances 2. As best seen by referring to FIG. 2 the raised portions or protuberances 2 and the not particularly referenced valleys located between such protuberances are profiled or shaped approximately in accordance with a footprint. The heel and toe ball come to lie in a valley of the mat, whereas the arch of the foot and the toes come to lie upon raised portions 2.

Figure 3:
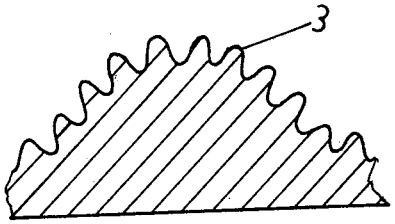
FIGS. 3 and 4 show different possible surface structures for the foot massage mat of the invention.
Figure 4:
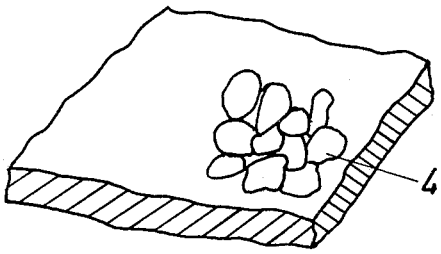

In FIG. 3 there is illustrated a surface structure of a foot massage mat wherein the mat surface is in the form of naps 3 or equivalent structure. On the other hand, FIG. 4 illustrates a round pebble-like surface structure formed of pebble or gravel elements 4.

Figure 5:
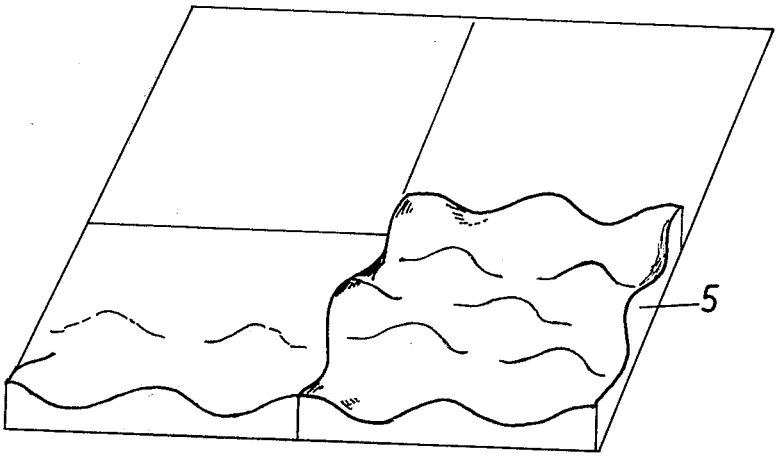
FIG. 5 illustrates a foot massage mat composed of tile-like individual elements.
Figure 6:
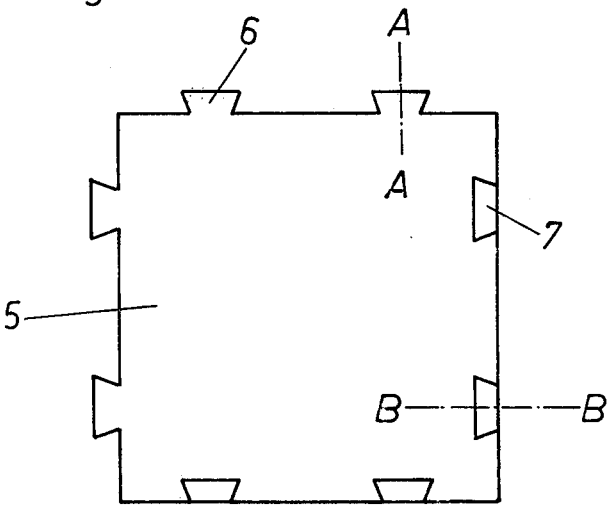
FIG. 6 illustrates details of one such individual element.
Figure 7:
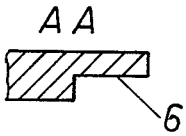
FIG. 7 is a fragmentary cross-sectional view showing details of a projection provided at the individual element, taken substantially along the line A—A of FIG. 6.
Figure 8:
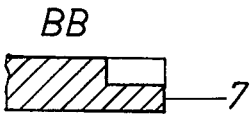
FIG. 8 is a cross-sectional view showing details of a recess provided at the individual element, taken substantially along the line B—B of FIG. 6.

In FIG. 5 there is shown a foot massage mat composed of four individual tile-like elements 5 which can be assembled together. The individual elements 5 are provided at their corners and at their edges with quarter parts and half parts of the raised portions or protuberances 2, so that the same can be augmented into full protuberances when similar type neighboring individual elements 5 are joined together. As shown in FIG. 6 the individual elements 5 are provided at their edges with dovetail-shaped projections 6 and recesses 7. Advantageously, these projections 6 and recesses 7 are only formed at the floor or base of the mat and do not extend up to the surface thereof, as will be evident by referring to FIGS. 7 and 8.

While there are shown and described present preferred embodiments of the invention, it is to be distinctly understood that the invention is not limited thereto, but may be otherwise variously embodied and practised within the scope of the following claims.

Accordingly, what I claim is:

1. A foot massage mat formed of rubber, plastics material or the like, comprising:

a mat structure provided with hill-like proturbances;

said protuberances being spaced from one another to form valleys therebetween;

each of said protuberances has an approximately circular configuration in plan view, the diameter of said circular configuration being between five and ten centimeters;

a plurality of said protuberances are distributively arranged in spaced relationship from one another;

the spacing of said protuberances from one another, measured from apex to apex between neighboring protuberances, amounts to between about eight and fifteen centimeters; and the spacing of said protuberances is coordinated to the foot of the user such that the heel and toe ball of the foot rest in a valley between said protuberances and the foot arch and toes rest upon raised portions.

2. The foot massage mat as defined in claim 1, wherein:

the height of the protuberances is in the order of between about one and four centimeters.

3. The foot massage mat as defined in claim 1, wherein:

the distribution of the protuberances is essentially uniform.

4. The foot massage mat as defined in claim 1, wherein:

the distribution of said protuberances is essentially irregular.

5. The foot massage mat as defined in claim 1, wherein:

said protuberances comprise raised portions at the surface of the mat and selectively having at least any one of different size or different spacing from one another.

6. The foot massage mat as defined in claim 1, wherein:

at least said protuberances have a structured surface pattern.

7. The foot massage mat as defined in claim 6, wherein:

said surface pattern comprises adjacently arranged naps.

8. The foot massage mat as defined in claim 6, wherein:

said surface pattern comprises a round pebble-like structure.

9. The foot massage mat as defined in claim 8, wherein:

said round pebble-like structure is formed by pebble elements of different size and having a length between about one to three centimeters.

10. The foot massage mat as defined in claim 9, wherein:

said pebble elements at least partially protrude from the surface of the mat by an amount in a range of about three to seven millimeters.

11. The foot massage mat as defined in claim 6, wherein:

said surface pattern is structured such that it enables complete run-off of liquid from the foot massage mat when inclined at an angle of about 45°.

12. The foot massage mat as defined in claim 1, wherein:

the foot massage mat has a surface which inclusive of possibly structured portions is macroscopically smooth and closed.

13. The foot massage mat as defined in claim 1, wherein:

the mat is assembled from tile-like individual elements.

14. The foot massage mat as defined in claim 13, wherein:

the edges and corners of the tile-like individual elements are formed so as to provide parts of the protuberances which can be augmented by analogously constructed neighboring individual elements.

15. The foot massage mat as defined in claim 14, wherein:

the individual elements comprise essentially square individual elements having the parts of the protuberances formed at the edges and corners and merging at all four sides into approximately the same contour.

16. The foot massage mat as defined in claim 13, wherein:

the tile-like individual elements are provided with mating lateral projections and recesses for joining together the individual elements.

17. The foot massage mat as defined in claim 16, wherein:

the lateral projections and recesses possess an essentially dovetail-shaped configuration.

18. The foot massage mat as defined in claim 1, wherein:

the mat is formed of semi-rigid polyurethane integral foam.

19. The foot massage mat as defined in claim 1, wherein:

said mat structure contains a base portion supporting said hill-like protuberances; and said mat base portion and hill-like protuberances being formed of the same material.

* * * * *